United States Patent [19]

Montierth et al.

[11] Patent Number: 5,004,190

[45] Date of Patent: Apr. 2, 1991

[54] RAIL HEATING APPARATUS

[75] Inventors: Garry L. Montierth, Newark; Stephen A. Logan, Redwood City; Raymond J. Scott, Redwood City, all of Calif.

[73] Assignee: Bylin Heating Systems, Inc., Redwood City, Calif.

[21] Appl. No.: 118,212

[22] Filed: Nov. 6, 1987

[51] Int. Cl.[5] ..... E01B 7/24

[52] U.S. Cl. ..... 246/428; 104/279; 105/451; 126/271.1

[58] Field of Search ..... 238/1; 104/279; 105/451; 246/415 R, 428, 444; 126/271.1, 271.2 B; 219/548, 213, 535

[56] References Cited

U.S. PATENT DOCUMENTS

| | | | |
|---|---|---|---|
| RE. 31,081 | 11/1982 | Keep, Jr. | 246/428 |
| 1,477,982 | 12/1923 | Shriver | 246/428 |
| 1,524,223 | 1/1925 | Wells | 246/428 |
| 1,959,107 | 5/1934 | Packer | 246/428 |
| 2,500,399 | 3/1950 | Broome | 246/428 |
| 3,243,573 | 3/1966 | Weisse et al. | 246/428 |
| 3,349,722 | 10/1967 | Davis | 246/428 |
| 3,394,251 | 7/1968 | King et al. | 246/428 |
| 4,334,148 | 6/1982 | Kampe | 219/548 |
| 4,391,425 | 7/1983 | Keep, Jr. | 246/428 |
| 4,429,845 | 2/1984 | Stover et al. | 246/428 |

OTHER PUBLICATIONS

"Installation and Maintenance Instructions for Raychem CRH-4 Third Rail Heaters", Jan. 13, 1987, pp. 8-12.

*Primary Examiner*—Margaret A. Focarino
*Assistant Examiner*—Joseph D. Pape
*Attorney, Agent, or Firm*—Flehr, Hohbach, Test, Albritton & Herbert

[57] ABSTRACT

A rail heating system is provided for heating railroad components such as railroad switch areas and electrified third rails. The heating system includes a side heater having a heating pad that has a flexible contact surface. A clip arrangement such as a spring steel clip is provided for securing the heating pads to the stock rail and pressing the contact surface into engagement with the rail. The contact surface of the heating pad is forced to conform to the shape of the contacted portion of the rail. Ground pan heaters may be used to keep areas of the switch that are not suitable for attachment by the side heaters, such as the switch rod, free from ice and snow.

20 Claims, 5 Drawing Sheets

RAIL HEATING APPARATUS

BACKGROUND OF THE INVENTION

The present invention relates generally to a system for heating railroad switches and rails to keep such components free from ice and snow.

An integral and essential component of railroad system hardware is the switching mechanism employed to shunt rail traffic from one rail line to another. These switches, or switch points, are typically comprised of at least one pair of stationary non-movable stock rails and one or more pairs of movable switch rails and a switch actuator mechanism. The switch may be broken down into two main areas. The switch point area which is near the free end of the movable railing and the switch heel area which is the portion where the switch rails are joined to the stock rails.

Within the railroad community, it is well known that a particular problem encountered during winter months is keeping railroad switches free from ice and snow. If the switches are frozen or jammed such that they may not be moved, they quickly bring the rail system to a stop. Therefore, railroads have been forced to try many methods to free frozen or jammed switches. Traditicnally, the railroads employed crews that would use picks and shovels to clear the switches. Another commonly used method was to douse the switch with diesel fuel and ignite the fuel to melt away any ice or snow. Clearly, such methods had substantial drawbacks.

More recently, electrical heating rods and air blowers (both hot and cold) have been used to melt or prevent the accumulation of ice and snow between and around the critical rail sections. The most common type of electrical heater rods presently used are uniform power output constant wattage series cables commonly referred to as tubular heaters, manufactured by Chromalox and others. These heaters are constructed from a series resistance wire encased in a metal tube filled with magnesium oxide dielectric insulation. Generally, they are constructed of a resistance wire having uniform resistance thereby resulting in uniform power output along the entire length of the rod. Such systems often fail due to migration of the resistance wire into contact with the metal tube which causes a short circuit. Additionally, when moisture leaks into the rod, problems arise because the moisture is absorbed by the very hygroscopic magnesium oxide causing either a dielectric failure or steam explosion. Additionally, although such systems are widely used, they are not well suited to sustain the vibration and abuse experienced in the rail environment. Therefore, they fail frequently which can cause disruption in normal rail traffic.

Rod style heaters are usually attached directly to the outside of the stationary (stock) rail. However, since these heaters are relatively long and inflexible, they cannot be bent to fit around the reinforcement braces which hold the stationary rails in place. Therefore, holes must be drilled or slots machined into the braces to allow the heater rods to pass therethrough. The rod style heaters also require a relatively high power output in order to compensate for poor heat transfer between the small diameter rod element and the relatively flat web of the stock rail. This results in large amounts of energy being wasted and extremely high heater temperatures (often the heaters glow red during use). Heaters used under such extreme conditions tend to fail early. Numerous attempts have been made to cover such heater rods with a material that increases the percentage of the energy transferred into the rail versus that lost to the ambient surroundings. For example, attempts have been made to place rod style heaters on the inside of the stock rail in order to have more energy radiate directly into the movable rail. Additionally, housings have been constructed about the heater rods in an attempt to minimize heat loss.

Air blowers operate on the principle that a stream of forced air directed at the gap between the movable point and the stationary rail will blow out any snow that falls into this area. However, in many situations, cold air blowers are inadequate for preventing ice buildup. Hot air blowers direct a stream of heated air into the gap to not only blow out any loose snow but also to melt any ice that may have accumulated to prevent interference with proper switch operation. Hot air blowers can be either electrically heated or gas fired. Unfortunately, the cost of operation is very high because of the large amount of air that must be heated and then exhausted into the environment. Therefore, there is a need for an improved switch point rail heater that consumes a minimum amount of energy while effectively keeping the switch area free from ice and snow.

Similar problems arise when attempting to keep electrified third rails efficiently and reliably de-iced. Therefore, there is a need for cost effective rail heating system for keeping various railroad components free from ice and snow without wasting large amounts of energy.

SUMMARY OF THE INVENTION

Accordingly, it is a primary objective of the present invention to provide an improved rail heating system that is particularly well suited for removing ice and snow from various railroad components.

Another object of the invention is to provide a rail heating device for removing ice and snow from railroad switches.

Another object of the invention is to provide a railway heating device for keeping electrical third rails free of ice and snow.

Another object of the invention is to provide a rail heating system that incorporates resistive heaters that do not require rail braces be bored through or milled into.

Another object of the present invention is to provide a variable watt density rail heating system that provides different levels of heat input along the rail.

To achieve the foregoing and other objects and in accordance with the purpose of the present invention, a rail heating system is provided for heating a rail having a web and a plurality of spaced apart braces for holding the rail in place. The rail heating system includes a heating pad having a flexible contact surface and a clip means for securing the heating pad to the rail and pressing the contact surface into contact with a portion of the rail web to match the contour of the contacted portion of the rail web. The heating pad preferably includes a resistive heating element and power receiving means provided for connecting the resistive heating element to an external power supply.

In one preferred embodiment, the rail heating system comprises a plurality of heating pads wherein each of the heating pads is sized and positioned to fit between two adjacent braces. The heating pads are preferably connected in electrical series with each resistive heating element including multiple parallel resistive paths.

In an alternative preferred embodiment, the heating pad includes a pair of elongated channel elements each having a longitudinal axis and a lateral surface extending substantially parallel to the longitudinal axis. The channel elements are pivotably coupled along their lateral surface to provide flexibility for matching the contour of the rail. In such a system the clip means may include a channel that applies uniform pressure to the strips and a plurality of clips for securing the channel to the rail.

In an alternative preferred embodiment, a plurality of side heaters are used in conjunction with a ground pan heater located beneath the switch rod. Each side heater is attached to a single rail segment that lies between adjacent braces, via a clipping means. A power receiving means connects the ground pan heater and the side heaters to an external power supply.

In a method aspect of the invention a plurality of side heaters are arranged to provide more heat to the switch point area than the switch heel area and simultaneously heat the switch rod.

BRIEF DESCRIPTION OF THE DRAWINGS

The features of the present invention that are believed to be novel are set forth with particularity in the appended claims. The invention, together with further objects and advantages thereof, may best be understood by reference to the following description taken in conjunction with the accompanying drawings in which:

DETAILED DESCRIPTION OF ILLUSTRATIVE EMBODIMENTS

Figure 1A:
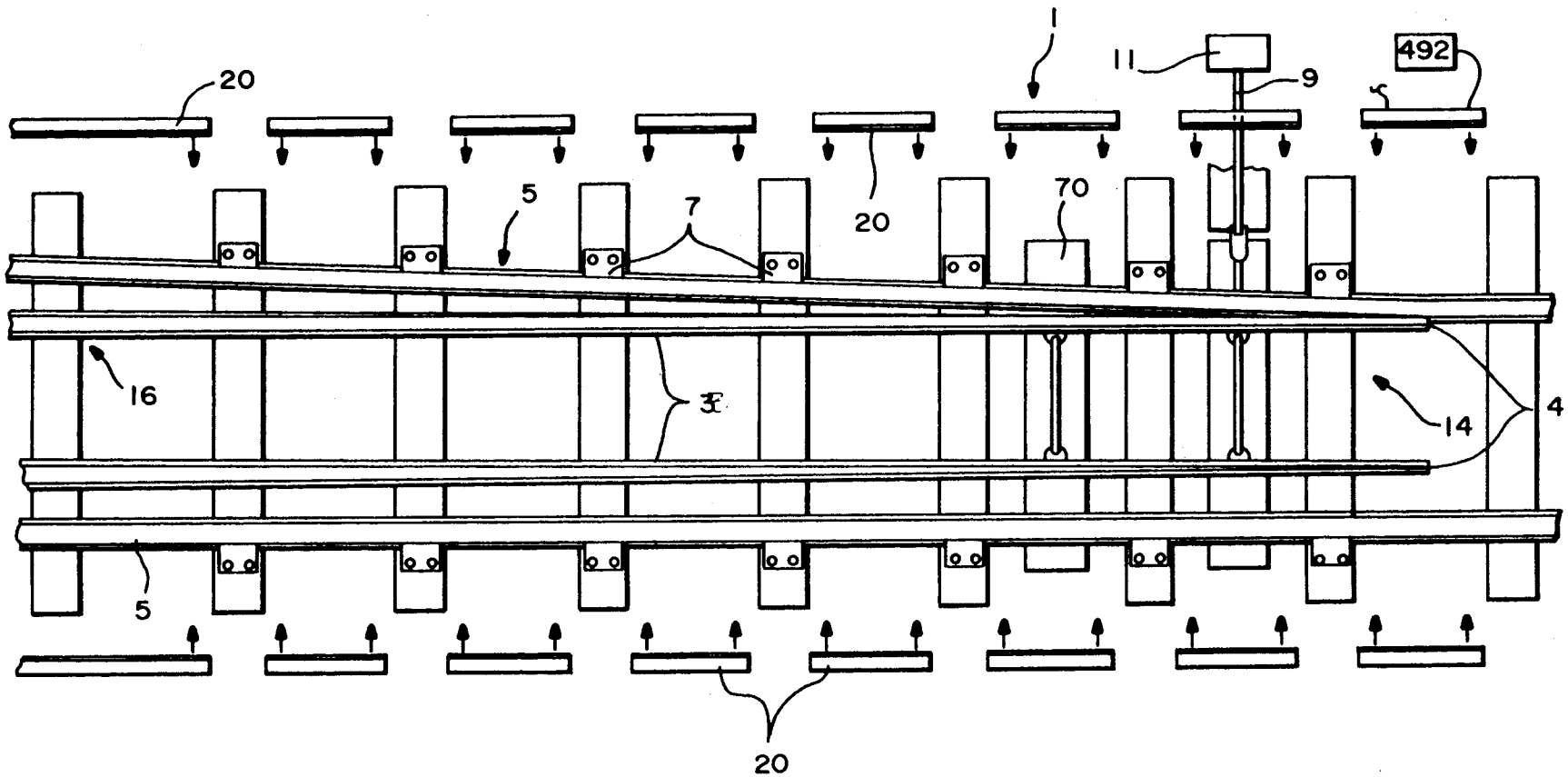
FIG. 1*a* is a schematic top view of a rail switch point showing the layout of a plurality of heaters in accordance with the present invention.
Figure 1B:
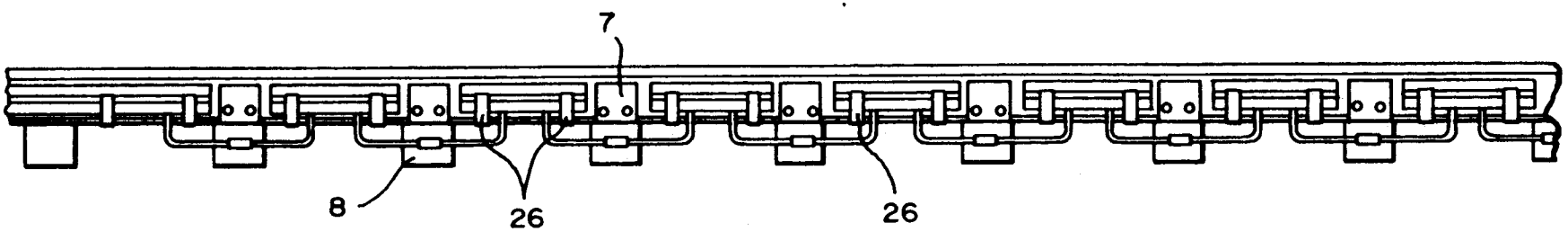
FIG. 1*b* is a side view of the layout shown of FIG. 1*a*.

Referring first to FIGS. 1*a* and 1*b*, it is noted that one of the broad purposes of the invention is to provide a rail switch point heating system for heating a railroad switch area 1 that includes movable switch rails 3 and fixed stock rails 5. A plurality of spaced apart braces 7 hold the stock rail 5 in place. The braces 7 are secured to railroad ties 8 and, in effect, divide the rail into segments. The switch has a switch point area 14 and a switch heel area 16. One or more switch rods 9 are provided for moving the switch rail point 4 back and forth and between stock rails 5. A switching machine 11 which may be either manually or automatically controlled, moves switch rods 9 back and forth to control the movement of the switch point 14.

The heating system 1 includes a plurality of side heaters 20, and may include one or more ground pan heaters 70. A clip means that includes a plurality of spring clips 26 is utilized for securing the heating pad 20 to the stock rail 5 and pressing its contact surface into contact with the rail. The side heaters 20 are sized to fit in between a pair of adjacent braces 7 which secure stock rails 5 to their underlying railroad ties 8. As will be appreciated by those familiar with the railroads, in the vicinity of the point portion of a switch 1, the braces 7 are typically mounted on each tie 8. Since the spacing between the various ties typically varies to some extent, and since farther away from the switch point, the braces are generally provided less frequently (as for example, every second or third tie). The actual distance between adjoining braces 7 may vary quite a bit. Therefore, if desired, the actual size of the side heaters may be varied to a large extent. A plurality of ground pan heaters 70 are positioned under other sensitive portions of the railroad switch 1. For example, they may be disposed beneath the switch rod 9 that connects switching mechanism 11 to the movable switch rails 3. Additionally, it may be desirable to place ground pan heaters 70 beneath other sensitive portions of the switch such as trip stop mechanisms.

In order to keep the switch operational in the face of ice and snow, more heat is necessary in the switch point area 14 than the switch heel area 16. Therefore, in many situations it will be desirable to place higher powered heaters in the vicinity of the switch point area, than in the switch heel area. The higher power heaters introduce more heat to the rail per unit length of rail. It is desirable to provide more heating to the switch point area because the switch rails move a large distance in that region and thus would tend to accumulate more ice and snow.

Figure 2:
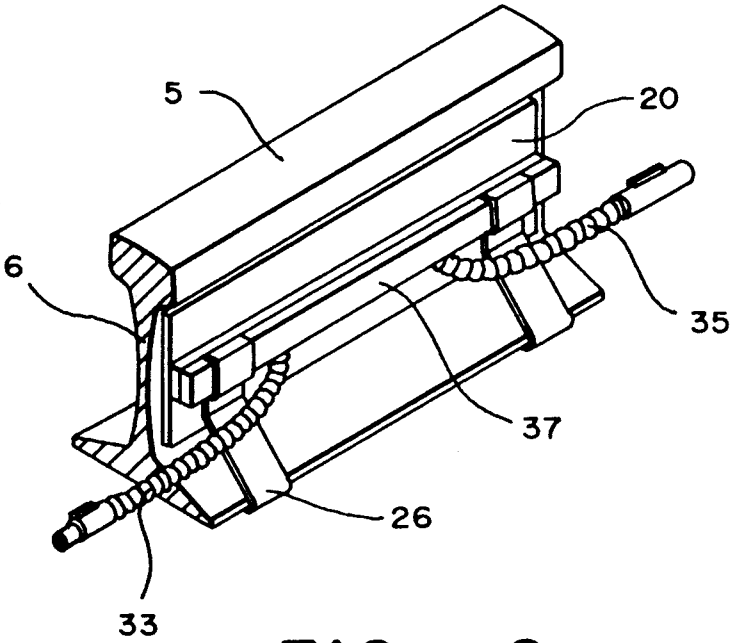
FIG. 2 is a perspective view of a side plate rail heater.
Figure 3:
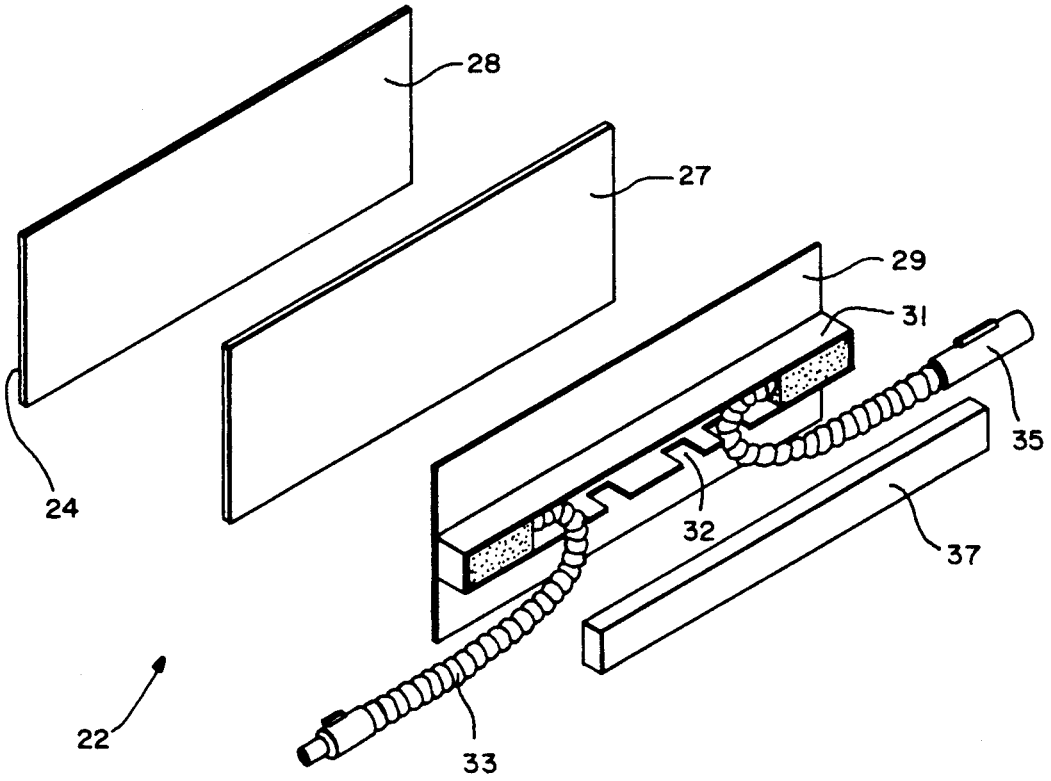
FIG. 3 is an exploded view of the side plate rail heater shown in FIG. 2.

One embodiment of a side heater suitable for use in the rail heating system is shown in FIGS. 2 and 3. The heater 20 is secured to the web portion of stock rail 5 by the plurality of flexible spring clips 26. The heater 20 includes a flexible heater pad 22 having a flexible contact surface 24, a channel 31 having a plurality of slots 32, an input connector 33 and an output connector 35. The heating pad 22 may include a resistive heating element 27 which generates heat and a thermally conductive coverplate 28. The coverplate 28 forms the contact surface 24 and is intended to both protect heater element 27 from the elements and to provide good thermal conductivity between the heater element and the stock rail 5. By way of example, a suitable coverplate 28 would be an aluminum or stainless steel sheet. It should be appreciated that the sandwich construction of heater pad 22 has sufficient flexibility to enable the contact surface 24 of coverplate 28 to conform to the contour of the adjacent portion of rail web 6 when pressed against rail 5 by clip 26.

Heater element assembly 27 may be any conventional resistive heater. By way of example, a multi-interconnected-channel resistive strip as described below and shown in FIG. 8 may be used. As described therein, the resistive heater may include a strip of resistive material such as Inconel 600. It will be appreciated that the resistive strip may be punched out to form a plurality of parallel paths or channels. Thus, the watt density of the heater may be adjusted by altering the configuration of the punched-out area.

Input connector 33 and output connector 35 each may include a flexible steel hose for carrying the electrical wiring. Input connector 33 may include either a male or female quick connect, positive backing fastener such as manufactured by Cam-Lock, Inc., Ohio, which is adapted to be received by a mating male or female fastener carried by the output connector 35 of an adjacent heater 20. In one preferred embodiment of the invention, as shown in FIG. 1, a plurality of heaters 20 are placed on stock rail 5 between adjacent braces 7, with only one heater being disposed between each adjacent pair of braces. Input connector 33 and output connector 35 are sized such that the input connector to the first heater may be coupled to the output connector of an adjacent heater by passing around the separating brace (or behind a drilled or milled brace) in order to combine the two in electrical series. It will be appreciated that with such an arrangement, any number of heaters may be placed in electrical series and connected to a suitable power supply 49, as shown in FIG. 1A. Depending upon the particular application of the rail heating system, it may be desirable to place all or only a few of the heaters in electrical series.

To facilitate connection between adjacent heaters, the apparent length of input connector 33 and output connector 35 may be varied. This is accomplished while cover 37 is not in place on channel 31 by threading the input and output connectors 33, 35 through different slot 32 in channel 31.

Figure 4:
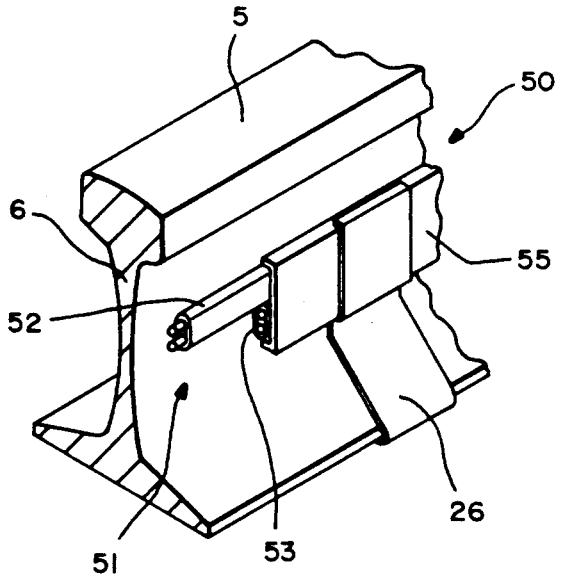
FIG. 4 is a perspective view of a channel type rail heater.
Figure 5:
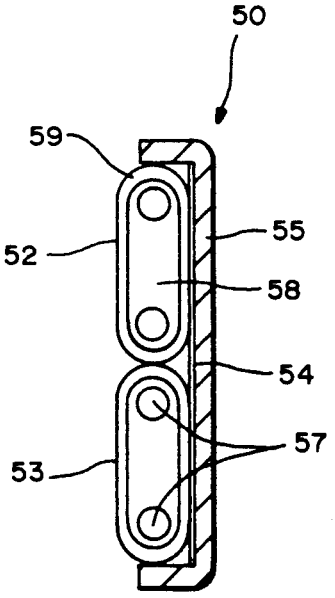
FIG. 5 is a an end view of channel type heater shown in FIG. 4.

FIGS. 4 and 5 show an alternative side rail heater design referred to herein as the channel type rail heater. Channel rail heater 50 includes a heating pad 51 and a fiberglass channel 55 having a layer 54. The heating pad 51 may include a pair of self-regulating or constant wattage heater cables 52 and 53. The heating cables 52, 53 are laid side-by-side and may be wrapped with flexible aluminum tape. The resulting assembly (heating pad 51) is able to conform to the contour of the rail against which it will be placed since the aluminum tape allows cable 52 to bend (pivot) relative to cable 53. The layer 54 is arranged to press the heating cables 52, 53 against the rail web 6.

The fiberglass channel 55 fits over the heating pad 51 with spring clips 26 holding the channel 55 against the rail 5. The fiberglass channel is relatively stiff and provides a mechanism for keeping the more flexible heater pad 51 in contact with the rail surface along the entire length of the heater pad 51. Such contact is important to promote good heat transfer between the heater pad 51 and the rail 5.

Each cable 52, 53 may include a pair of spaced apart conductors 57 to which an alternating voltage potential is applied. A conductive plastic 58 material fills the gap between the conductors. Applying a differential voltage between spaced apart conductors 57 causes current to pass through the conductive plastic 58, thereby generating heat. Such an arrangement may be self-limiting if the resistance of the conducting plastic 58 is temperature dependent, with the resistance increasing as the temperature increases. A suitable self-limiting conductive plastic is DHDA 7707, manufactured by Union Carbide. An outer cover 59 formed of an electrically insulative material such as TPR 5595 from British Petroleum encases the electrically conductive plastic 58.

The channel rail heater is particularly well adapted for applications where there are extended spaces between braces or other objects which must be worked around. Therefore, a channel rail heat type construction is particularly suitable for heating electrified third rails and/or placement near the heel end of a switch assembly.

Figure 6:
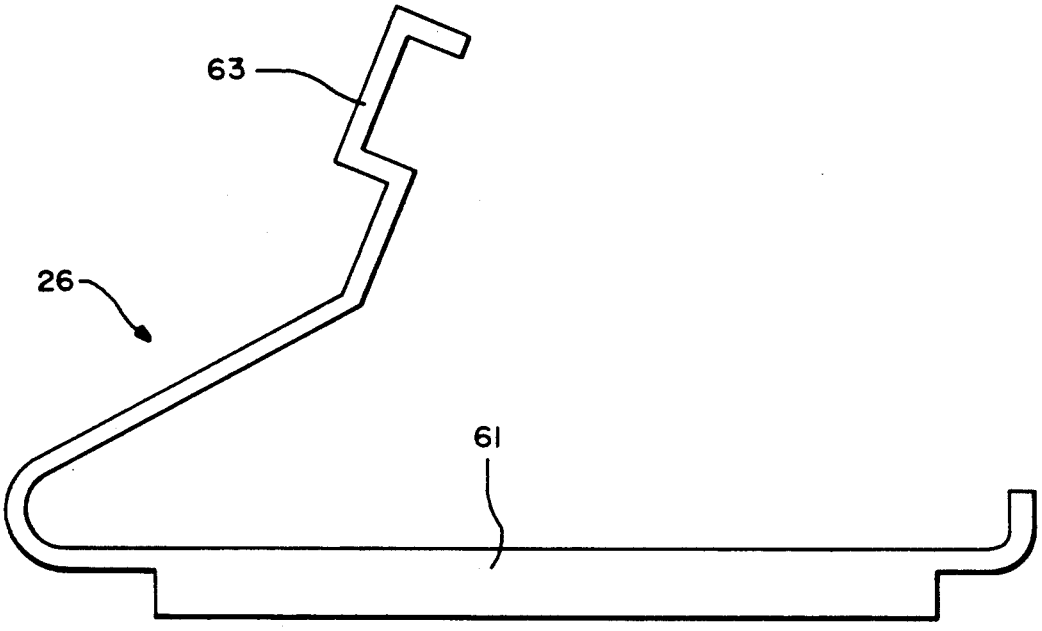
FIG. 6 is a side view of a spring steel clip suitable for mounting the side plate rail heater and the channel type rail heaters shown in FIGS. 2 and 4 respectively.

Referring next to FIG. 6, a representative spring clip 26 suitable for securing side heaters to the rail will be described. Spring clip 26 is formed of a tempered material that will return to its original shape after deformation under a load. By way of example, a suitable material for forming spring clip 26 is tempered spring steel. The spring clip 26 includes a base portion 61 adapted to engage the base portion of a rail and a fitted portion 63 which is adapted to engage the side rail heater and press it into contact with the rail webbing.

Figure 7:
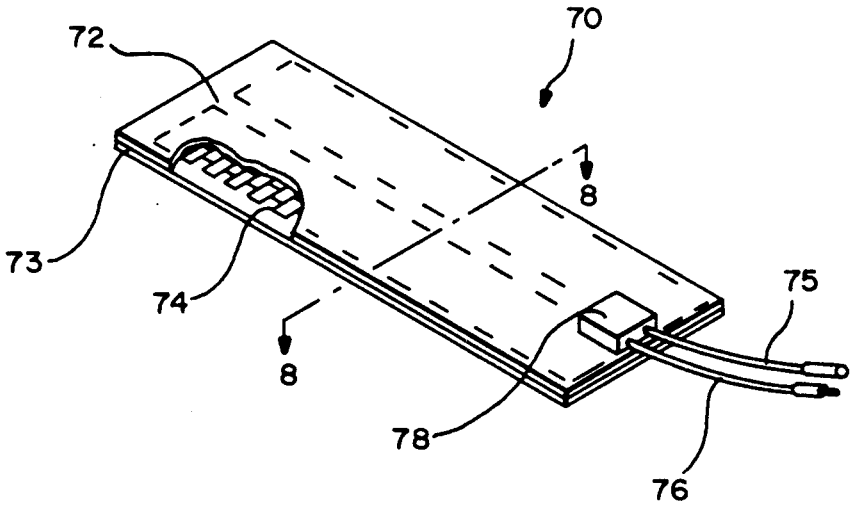
FIG. 7 is a perspective view of a ground pan rail heater.

While the side plate heaters and the channel rail heaters are very effective at heating the rails themselves, they are not particularly well adapted to heating other critical areas of the switch assembly such as the switch rod 9 and trip stop mechanisms. Therefore, we have developed a flat heater which lies on the ground underneath the other critical parts to provide the heat necessary to melt away ice and snow. One embodiment of the device is shown in FIG. 7 and is referred to as a ground pan heater. The ground pan heater 70 is essentially a flat rectangular heating element that is placed in the area desired to be heated. The ground pan heater 70 includes a pair of flat metal panels 72, 73 which sandwich a heater element assembly 74, input and output connectors 75, 76 and a junction box 78. By way of example, the heater element assembly 74 may be a resistive heater fabricated as described with reference to FIG. 8. Input and output connectors 75, 76 may be connected to an external power supply to power the resistive heater.

The top and bottom metal panels 72, 73 serve to protect the heater element assembly 74 from physical damage and to give the unit adequate weight to stay in place during windy ambient conditions and under the influence of the suction created by passing trains. Additionally, metal tie-down bars may be used to affix the heaters to the ties. The junction box 78 may be spot-welded to the top panel 72 to provide a protected location for the input and output connector 75, 76 to attach to the heater element 74. The input and output connectors are welded to the respective heater element leads and the heater element assembly is attached to the top and bottom plates with a high temperature, waterproof silicone adhesive. The heater element leads pass through an access hole in the top panel 72 into the junction box.

Figure 8:
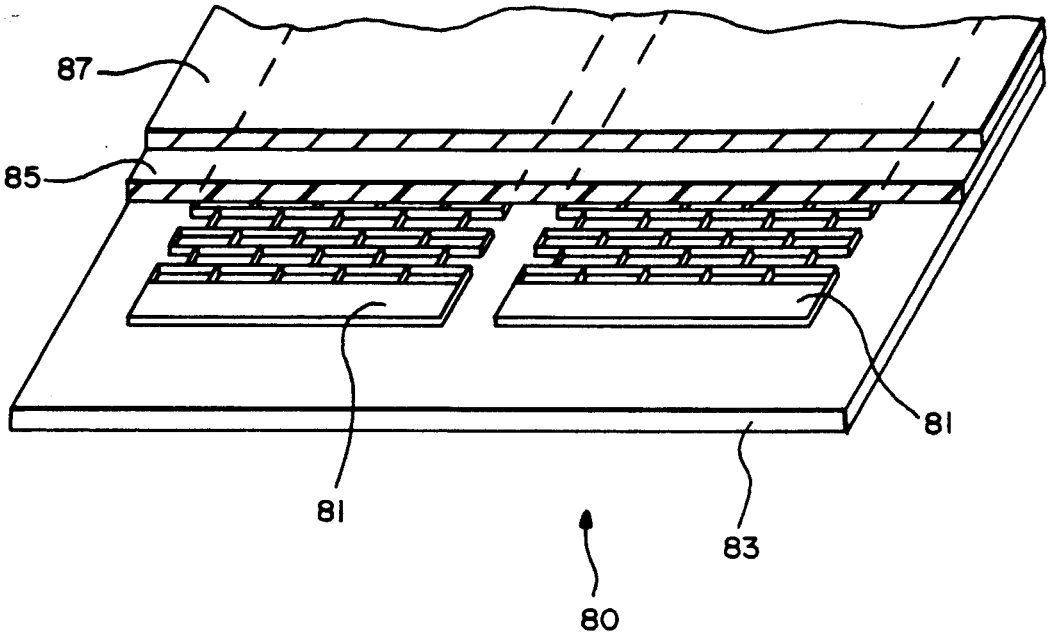
FIG. 8 is a partially broken away view of a resistive heater element suitable for use in the side plate heaters and the ground pan heaters shown in FIGS. 2 and 7 respectively.

Referring next to FIG. 8, a resistive heater assembly 80 suitable for use in the side plate heaters 20 and the ground pan heaters 70 will be described. An Inconel heating element 81 is arranged on a layer of fiberglass reinforced silicone rubber 83 so that a large percentage of the rubber's area is covered by the heating element 81. By way of example, the Inconel heating element 81 may take the form of a thin, 0.002"–0.004" sheet of metal having a regular punched out pattern along its length forming multiple parallel resistive electrical paths. It is desirable to have the heating element 81 as broad as possible to distribute the power output throughout as much of the heater assembly 80 as possible, thereby enhancing its overall heat transmitting abilities. A second layer of fiberglass reinforced silicone rubber 85 is placed over the Inconel heating element 81 and has a pair of small slits that allow the heater element leads to pass therethrough. The heater assembly 80 is then pressed together between hydraulically operated rollers to eliminate air bubbles between the two layers of silicone rubber. The heater assembly is then laminated and heat cured to render it watertight. The contact surface of the heater assembly 80 is typically adhered to a metal sheet 97 (such as aluminum or stainless steel) which facilitates heat transfer between the heater assembly 80 and the area sought to be heated. It should be appreciated that variations in the punch pattern of the heating element 81 will vary the resistance at that particular point. Variations in resistance regulate the power output in that portion of the heater which in turn regulates the heat transferred. It will be appreciated that such a heater construction allows wide variation in the watt density output along the face of the heater merely by altering the punch pattern in heating element 81. Additionally, it should be appreciated that this construction is inherently constant wattage since the resistance of the Inconel heating element does not change appreciably over the operating temperature range.

Figure 9:
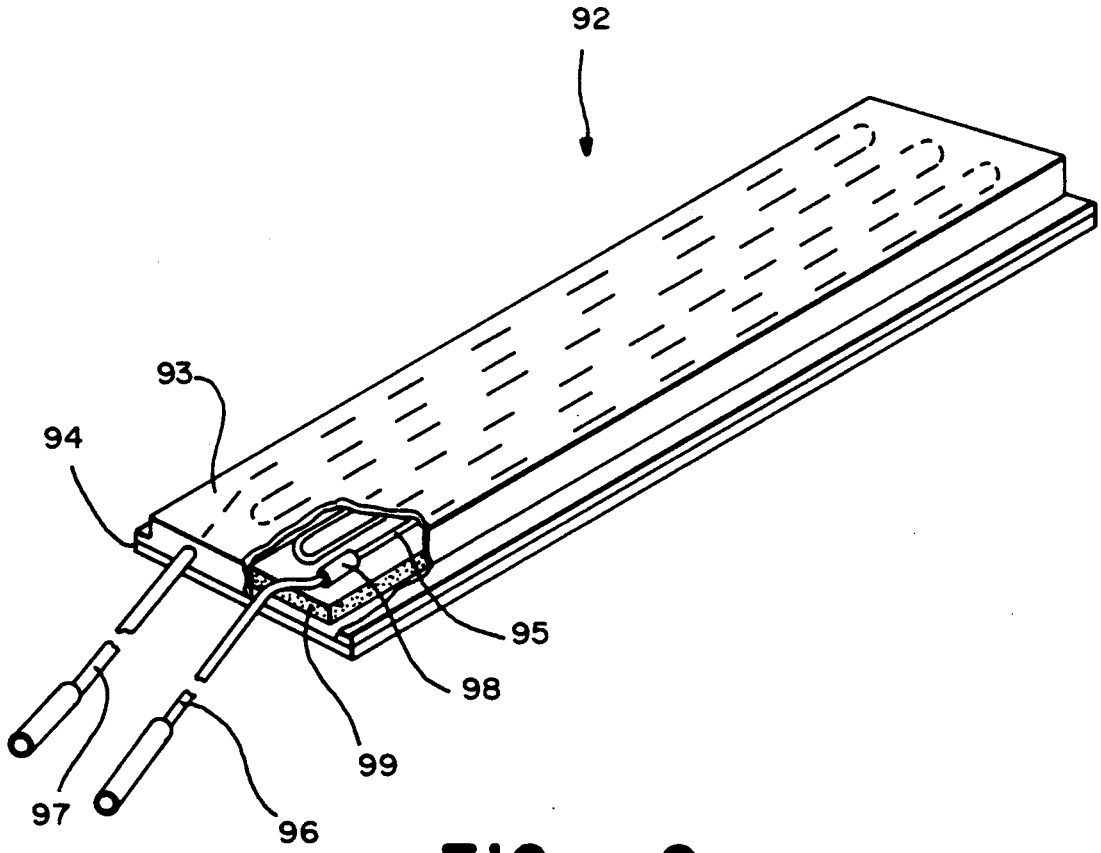
FIG. 9 is a partially cut away perspective view of a self-limiting ground pan rail heater.

Another embodiment of the device is shown in FIG. 9 and is referred to as a self-limiting ground pan heater. In this embodiment the heater element is based on a material that changes in resistance as a function of operating temperature. The heater 92 includes a pair of formed metal panels 93, 94 which enclose a self-limiting heater element assembly 95, and input and output connectors 96, 97. Input and output connectors 96, 97 may be connected to an external power supply to power the heater.

The top and bottom metal panels 93, 94 serve to house and protect the heater element assembly 95 from physical damage and to give the unit adequate weight to stay in place during windy ambient conditions and under the influence of the suction created by passing trains. The input and output connectors are fastened to the heater element with crimp connectors 98 and the heater element assembly is attached to the top plate with high temperature, thermally conductive tape not shown. A closed cell, compressive foam insert 99 between the bottom plate and heater element serves to keep the heater element assembly pressed against the top plate to optimize heat transfer to the area sought to be heated.

Although only a few embodiments of the present invention have been described herein, it should be understood that the present invention may be embodied in many other specific forms without departing from the spirit or scope of the invention. Particularly, it should be appreciated that there are a wide variety of heating element constructions that may be substituted for those described herein. Further, the actual number of heaters that would be necessary in the rail switch area may vary widely with the geographical location of the switching area. Similarly, the relative number of side rail heaters used versus the number of ground pan heaters used will depend to a large extent upon the actual switch construction. For example, if the switch rail has an area which is unsuitable for mounting side heaters, ground pan heaters could be laid thereunder to accomplish the same task, although perhaps not as efficiently. Similarly, the choice of whether to use channel type heaters or side plate type heaters or their equivalent will depend a great deal upon the actual size and construction of the rails and the space in between braces or other objects which prevent adherence of long strip to the rail. Similarly, the heat requirements of the particular rail portion will have a strong impact on the type of rail heater selected. Therefore, the present examples and embodiments are to be considered as illustrative and not restrictive, and the invention is not to be limited to the details given herein, but may be modified within scope of the appended claims.

We claim:

1. A rail heating system for heating a railroad rail having a contoured web, the rail being supported by support means that holds the rail in place, the rail heating system comprising:

a heating pad having a flexible contact surface with sufficient flexibility to deform to match the contour of said rail web;

clip means for pressing the heating pad contact surface into contact with a portion of the rail web and deforming the contact surface to match the contour of the contacted portion of the rail web.

2. A rail heating system as recited in claim 1 wherein said heating pad further comprises a resistive heating element and electrical contact means for connecting the resistive heating element to an external power supply.

3. A rail heating system as recited in claim 2, wherein said support means includes a plurality of spaced apart braces, the rail heating system further comprising a plurality of heating pads wherein each said heating pad is sized and positioned to fit in between two adjacent braces.

4. A rail heating system as recited in claim 3 wherein said heating pads are connected in electrical series, there being first and second end heating pads.

5. A rail heating system as recited in claim 4 wherein said electrical contact means includes cooperative input and output means for electrically connecting the output of one heating pad to the input of an adjacent heating pad and for connecting the end heating pads to a power supply, said cooperative input and output means being sized and positioned such that if one of said braces separates adjacent heating pads, the connection therebetween is made by passing about the separating brace.

6. A rail heating system as recited in claim 2 wherein said heating pad further comprises a channel having a removable cover for accessing said electrical contact means, said electrical contact means including an input connector cord and an output connector cord.

7. A rail heating system as recited in claim 6 wherein said channel includes a plurality of slots through which the input and output connector cords may be fed, said slots serving to provide means for effectively lengthening and shortening the input and output cords.

8. A rail heating system as recited in claim 2 wherein said resistive heating element includes a flexible heating element having a punched pattern therein that forms a multiplicity of parallel resistive paths, and a flexible watertight cover that protects said flexible heating element.

9. A rail heating system as recited in claim 2 wherein said resistive heating element has a variable watt density.

10. A rail heating system as recited in claim 2 wherein said resistive heating element is self limiting.

11. A rail switch heating system for heating a railroad switch having a point area and a heel area, the switch including a switch rail point, a stock rail having a web, support means for holding the stock rail in place, the support means effectively dividing the stock rail into a plurality of rail segments, and a switch rod for moving the switch rail point between a first position and a second position, the rail heating system comprising:

a plurality of side heaters, each said side heater having a flexible contact surface with sufficient flexibility to deform to match the contour of said rail web and being adapted for attachment to a single rail segment;

clip means for securing the side heaters to the stock rails and pressing the flexible contact surface into contact with the rail web along its entire length; and power receiving means for connecting said side heaters to an external power supply.

12. A rail switch heating system as recited in claim 11 wherein said side heaters are connected in electrical series, there being first and second end side heaters.

13. A rail switch heating system as recited in claim 12 wherein said support means includes a plurality of spaced apart braces and said power receiving means includes cooperative input and output means, for connecting the output of a first side heater to the input of an adjacent side heater and connecting the end side heaters to a power supply, said cooperative input and output means being sized and positioned such that if one of said braces separates adjacent side heaters, the connection therebetween is made by passing about the separating braces.

14. A rail switch heating system as recited in claim 11 further comprising a ground pan heater for disposition beneath the switch rod, wherein each said side heater and said ground pan heater each include a resistive heater element.

15. A rail switch heating system as recited in claim 14 wherein each said resistive heater element is self-limiting.

16. A rail switch heating system as recited in claim 14 wherein each said resistive heater element has a plurality of parallel electrical paths.

17. A rail switch heating system as recited in claim 14 wherein said resistive heating elements have variable watt densities.

18. A rail switch heating system as recited in claim 11 wherein the side heaters disposed nearest the switch point have a higher heat input into said stock rail per unit foot of rail than the side heaters disposed nearest the switch heel.

19. A method of heating a railroad switch to prevent ice and snow from jamming the switch, the switch having a switch point area and a switch heel area and including a switch rail having a switch rail point, a stock rail, and a switch rod for moving the switch rail point between a first position and a second position, the method comprising the steps of:

heating the stock rail with a plurality of resistive heaters coupled to the stock rial that are arranged to directly conduct more heat to the portion of the stock rail in the switch point area than the portion of the stock rial in the switch heel area.

20. A method as recited in claim 19 further comprising the step of simultaneously heating the switch rod with a heating pad disposed underneath the switch rod.

* * * * *